US005542318A

United States Patent [19]

Wesch, Jr.

[11] Patent Number: 5,542,318

[45] Date of Patent: Aug. 6, 1996

[54] BI-DIRECTIONAL GRIPPING APPARATUS

[76] Inventor: William E. Wesch, Jr., P.O. Box 3388, Odessa, Tex. 79760

[21] Appl. No.: 234,063

[22] Filed: Apr. 28, 1994

[51] Int. Cl.[6] ..... B25B 13/50

[52] U.S. Cl. ..... 81/57.33; 81/57.2

[58] Field of Search ..... 81/57.33, 57.18–57.21, 81/57.44, 57.15, 57.16, 57.34

[56] References Cited

U.S. PATENT DOCUMENTS 3,875,826 4/1975 Dreyfuss et al. ..... 81/57.18

4,869,137 9/1989 Slator ..... 81/57.2 X 5,172,613 12/1992 Wesch, Jr. ..... 81/57.33

*Primary Examiner*—D. S. Meislin

*Attorney, Agent, or Firm*—Crutsinger & Booth

[57] ABSTRACT

Bi-directional gripping apparatus having a double-seated linkage supports a jaw within a housing so that the jaw may be used to grip an elongated body and exert force thereon in opposite directions. The jaw is mounted to exert radial force in either direction or axial force in either direction.

9 Claims, 4 Drawing Sheets

BI-DIRECTIONAL GRIPPING APPARATUS

Bi-DIRECTIONAL GRIPPING APPARATUS

This invention relates to improvements in gripping means of the type disclosed in U.S. Pat. No. 5,172,613 issued Dec. 22, 1992 , entitled Power Tongs with Improved Gripping Means. The power tongs and back-ups disclosed herein have improved means for gripping pipe and tubular members. Torque is applied and held with minimum damage to the pipe or tubular member. A plurality of gripping assemblies, each including a pivoted jaw having a friction surface, are controlled by an assembly which causes the jaws to make contact with or be released from the pipe prior to any torque being applied to the pipe.

The disclosure of U.S. Pat. No. 5,172,613 is incorporated herein by reference in its entirety for all purposes. That patent discloses a drag ring which is turned to move the gripping assemblies into and out of contact with the tubular surface of the pipe. However, the gripping assemblies apply torque in only one direction. To reverse the direction of the torque applied to the pipe, the pipe is removed from the gripping assemblies and the pivoted jaws are moved to a different position.

Power tongs are devices used to secure together ("make up") and detach ("break out") threaded ends of two adjacent tubular products such as pipe sections by gripping, applying torque to and rotating one of the sections. Other devices known as back-ups are often used in conjunction with such tongs to grip and prevent rotation of the other of the two adjacent sections of pipe. Power tongs and back-up tools used to make up or break threads in connections between tubulars such as production tubing, casing, drill pipe and the like in the oil industry, often damage the tubulars. It will be recognized that terms such as "pipe" and "tubular" as used herein include tubing and other cylindrical objects and that the apparatus disclosed herein may be used to transmit torque as well as limit movement of the body to which it is applied.

In recent years major oil companies have required the drill string pipes or tubular products to be screwed and torqued together without damage to the tubulars so that stress and corrosion concentrations will not occur in the tubulars in the tears and gouges caused by the tongs and/or back-up teeth. In addition, to maintain integrity of the threaded connection it is desirable to reduce deformation of the pipe by the power tongs and back-ups near the location of the threads, thus allowing more compatible meshing of the threads and reducing frictional wear.

U.S. Pat. No. Re 31,993 (incorporated herein by reference for all purposes) issued Oct. 1, 1985 as a reissue of U.S. Pat. No. 4,281,535 and describes means to accomplish the task of making and breaking the threaded joints of such tubular members.

Gouging and tearing of pipe is caused in some instances by a number of undesirable conditions which cause concentration of the gripping force applied by the tong or back-up. For example, one such condition is insufficient contact area between gripping teeth of the tong or back-up and the pipe. Another is inadequate contact by one or more of a number of gripping members which engage the pipe, causing the gripping force to be concentrated with and applied by the remaining members. Still further, the gripping surface presented to the pipe may not conform in radius to the outer diameter of the pipe, causing uneven distribution of the gripping force across the surface of the pipe and concentrations at drastically reduced contact areas between the pipe and gripping mechanism.

Mis-alignment of the tong or back-up with the pipe may also cause gripping force concentrations leading to pipe damage. If the tong or back-up is not aligned axially with respect to the pipe, the gripping surfaces may contact the pipe at an angle, thus causing the gripping force to be applied to the pipe along the edge of a gripping surface, for example. Typically, this damages the pipe because the pressure applied to the pipe is concentrated in the relatively small area of contact between the gripping mechanism and pipe instead of being spread over the entire face of the mechanism.

In conventional tongs, pressure applied by the gripping jaws is not distributed evenly around the pipe but is applied to areas spaced around the perimeter of the pipe. This causes undue deformation of the pipe as the jaws impinge against its surface. Since the jaws typically grip the pipe adjacent the threads in couplings used to secure adjacent pipe sections, the threads deform with the pipe. Such deformation causes leaks across the threads, thereby reducing the useful life of the pipe. Furthermore, internal protective coatings can be damaged if the pipe diameter is deflected by the gripping means.

The invention disclosed herein improves pipe support and allows torque by proportional gripping during make or break of threaded connections. These improvements are achieved because a much larger gripping force angle is employed to exert force acting perpendicular to the pipe axis. For any given torque, the radial force is predetermined and balanced on the pipe. The gripping jaw area (as well as number and size of teeth) is sized to reduce the forces tending to crush the tubular body to a magnitude less than the yield strength of the tubular body. An important feature of apparatus employing the invention is that it will hold pipe in either a clockwise or a counter-clockwise direction without changing the structure and the magnitude of force applied to the pipe to hold the pipe in proportion to the rotary torque applied in either direction.

In accordance with the invention surfaces on jaws having a high coefficient of friction are urged into frictional engagement with a surface of an elongated member having an outer surface and a longitudinal axis. When force is applied to the elongated member tending to move the elongated member, the surfaces on the jaws are rotated about an axis spaced from the longitudinal axis of the elongated member to increase pressure between the surfaces on the jaws and the surface of the elongated member for applying a braking force to limit movement (or transmit torque) of the elongated member in at least two directions.

A force link having spaced bosses arranged to form double journals is positioned adjacent a nest member, having spaced bearing surfaces arranged to form double seats for rotating the surface on the jaw about an axis spaced from the longitudinal axis of the elongated member. The force link is pivotally secured to a tension carrying member which is pivotally secured to the nest member having the spaced bearing surfaces so that movement of the force link in either of two opposite directions moves one of the bosses into engagement with one of the spaced bearing surfaces.

A preferred embodiment of the bi-directional gripping apparatus includes the nest member having spaced bearing surfaces, the force link having a pair of bosses, a strap having one end pivotally connected to the nest member for rotation about a first axis and a second end pivotally secured to the force link for rotation about a second axis. A jaw having a gripping face is pivotally connected to the force link for rotation about a third axis. The surface on an elongated tubular member, having a fourth axis, is urged into frictional engagement with the gripping face on the jaw. When the jaw and force link are in a neutral position the first, second, third and fourth axes are in alignment so that rotation of the elongated tubular member relative to the gripping face on the jaw in either direction about the fourth axis transmits force through the jaw for moving the third axis out of alignment with the first and fourth axes for moving one of the bosses into engagement with one of the spaced bearing surfaces on the nest member.

After one of the cylindrical bosses on the force link moves into engagement with one of the spaced bearing surfaces on the nest member, further rotation of the force link, until a shoulder on the force link engages an abutment on the jaw, is about either a fifth or a sixth axis that is farther away from the axis of the tubular member than the second axis, about which the force link initially rotated, such that friction force between the jaw and the surface of the tubular member increases to resist rotation of the tubular member in either direction.

A preferred embodiment of the invention is illustrated in the drawing annexed hereto so that the invention may be better and more fully understood. Numeral references are employed to designate like parts throughout the various figures of the drawing in which.

Figure 1:
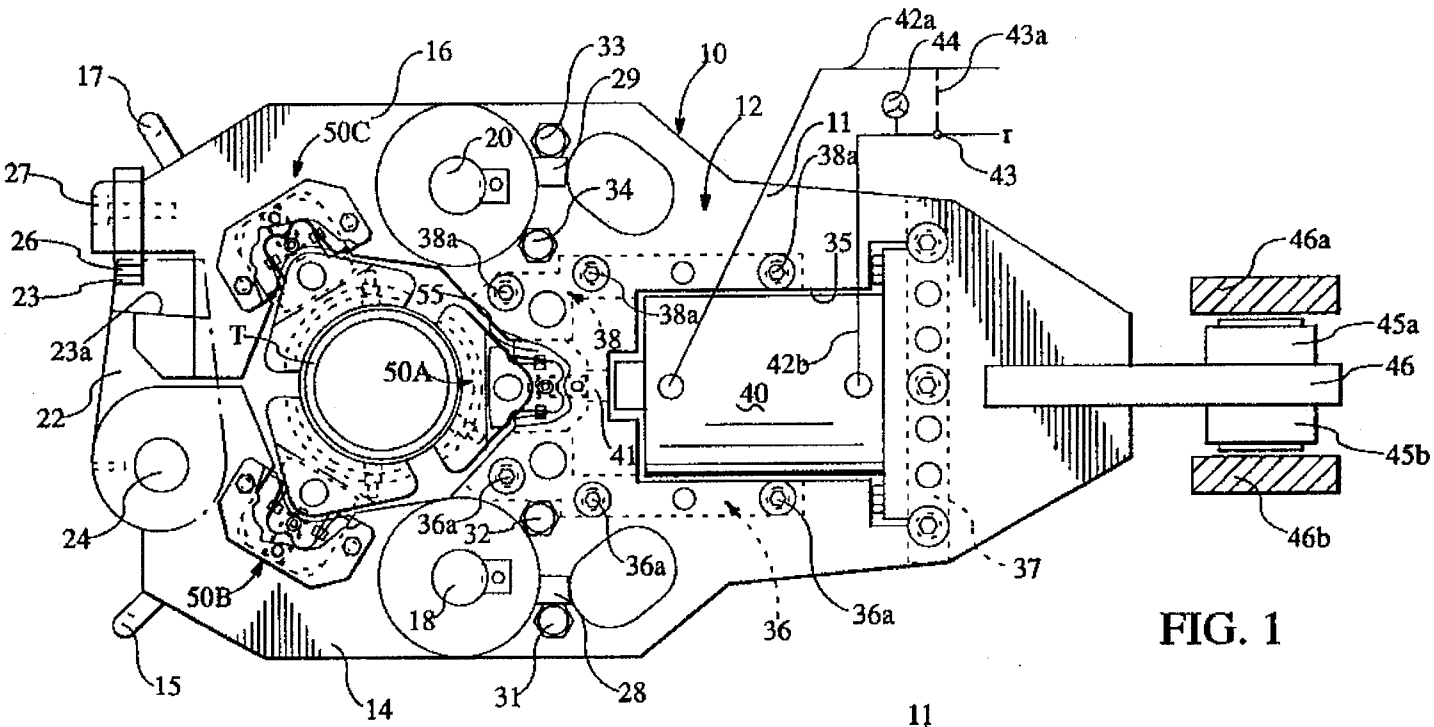
FIG. 1 is a top plan view of a back-up tool having bi-directional gripping apparatus mounted thereon.
Figure 2:
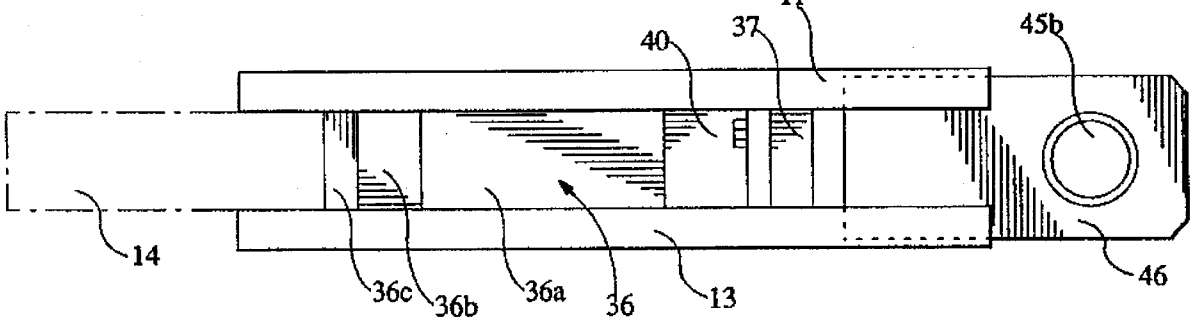
FIG. 2 is a side elevational view of the back-up tool illustrated in FIG. 1.

Referring to FIGS. 1 and 2, the numeral 10 generally designates a back-up tool having a body 12 formed by spaced top and bottom plates 11 and 13 and a pair of arms 14 and 16 pivotally secured to the body 12 by pins 18 and 20. A door arm 22 is pivotally secured by a door hinge pin 24 to the outer end of arm 14. Arms 14 and 16 are illustrated in a closed position in FIG. 1 of the drawing and door arm 22 is illustrated in a closed position.

Door arm 22 has a slot 23 formed in the outer end thereof for receiving a shear bar 26 pivotally secured by a bolt 27 to the outer end of arm 16. A handle 15 is mounted on arm 14 and a handle 17 is mounted on arm 16 to facilitate rotating arms 14 and 16 about pins 18 and 20 for opening and closing the back-up tool 10 about an elongated member T, such as a hollow joint of tubing or casing, a solid sucker rod, a drill bit or other tool used in well drilling or servicing operations. While the elongated member illustrated in FIG. 1 of the drawing is circular, it should be appreciated that the cross-section of the elongated member may assume other and further configurations.

Lugs 28 and 29 project outwardly from inner ends of arms 14 and 16. Spaced stop bolts 31 and 32 extend through body 12 adjacent opposite sides of lug 28 and stop bolts 33 and 34 extend through body 12 adjacent opposite side of lug 29. When arms 14 and 16 are in the closed position illustrated in FIG. 1 of the drawing, lug 28 on arm 14 engages stop bolt 31 and lug 29 on arm 16 engages stop bolt 33. When arm 14 is rotated in a counterclockwise direction about pin 18, lug 28 engages stop bolt 32 to limit outward rotation of arm 14. When arm 16 is rotated in a clockwise direction, as illustrated in FIG. 1 of the drawing, about pin 20, lug 29 moves into engagement with stop bolt 34 to limit outward movement of arm 16.

As best illustrated in FIG. 1, top plate 11 of body 12 has an opening 35 formed therein to facilitate mounting a fluid actuated cylinder 40 for actuating gripper assembly 50A, as will be hereinafter more fully explained.

A pair of spacers 36 and 38 (as best illustrated in FIG. 2) are mounted between top plate 11 and bottom plate 13 and secured in position by bolts 36*a* and 38*a* . Forward ends of spacers 36 and 38 have substantially flat vertically extending surfaces spaced apart to accommodate a nest member 55 movably mounted in a socket bounded on sides by spacer members 36 and 38 and at the top and bottom by top plate 11 and bottom plate 13. A third spacer 37 extends transversely across a rear portion of body 12 adjacent the rear edge of opening 35 and is configured to form a mounting plate for hydraulic cylinder 40.

While arms 14 and 16 in the illustrated embodiment of the back-up tool 10 are manually operated by handles 15 and 17, it should be readily appreciated that arms 14 and 16 may be pivoted about pins 18 and 20 by air cylinders, hydraulic cylinders, fluid driven motors or other drive means if it is deemed expedient to do so. When arms 14 and 16 are in the closed position (as illustrated in FIG. 1) door arm 22 is rotated in a clockwise direction about hinge pin 24 for positioning slot 23 adjacent shear bar 26. Shear bar 26 is rotated into slot 23 for latching door arm 22 in the closed position. Shear bar 26 is urged toward the closed position by gravity and is shaped such that gravity holds it in the closed position. Adjacent surfaces 23*a* on arm 16 and door bar 22 are preferably inclined at an angle of about 5 degrees relative to the centerline of body 12 to eliminate any tendency of the door bar 22 to kick open when arms 14 and 16 are urged outwardly.

The back-up tool 10 shown in the illustrated embodiment is provided with three bi-directional gripping assemblies 50A, 50B and 50C which will be described hereinafter in more detail. Gripper assembly 50A is slideably mounted in the body 12 of back-up tool 10. Gripper assembly 50B is mounted on arm 14 and gripper assembly 50C is mounted on arm 16. Gripper assembly 50A is mounted in a slot in body 12 and is movable radially toward and away from the elongated member by a fluid actuated cylinder 40 having a piston rod 41 connected to gripper assembly 50A. Fluid actuated cylinder 40 is a double-acting hydraulic cylinder having control lines 42*a* and 42*b* communicating with opposite ends of the cylinder on opposite sides of a piston (not shown) which is moved through the cylinder when fluid pressure is alternately applied to opposite ends thereof. A pilot operated check valve 43 having a pilot line 43*a* is mounted in control line 42*b* and a pressure gauge 44 is mounted in control line 42*b*.

When the rod 41 of cylinder 40 is extended, surfaces having a high coefficient of friction on grippers 100 on gripper assemblies 50A, 50B and 50C are urged into engagement with the surface of pipe T to establish a preload force between grippers 100 and pipe T. It should be appreciated the preload force of cylinder 40 may be created by mechanical means such as a fluid motor actuated threaded member, a fluid-driven cylinder wedge, toggle or other means.

Load cells 45*a* and 45*b* are mounted on opposite sides of a bracket 46 projecting outwardly from the rear end of body 12. Load cells 45*a* and 45*b* alternately engage stops 46*a* and 46*b* when torque is applied through body 12 by the elongated member. Load cell pressure is conveyed to a gauge which indicates the torque applied to the tubular member 10.

Gripping assemblies 50A, 50B and 50C are of substantially identical construction except that gripper assembly 50A is mounted for sliding movement through body 12 while gripper assemblies 50B and 50C are in stationary mountings on arms 14 and 16.

Figure 3:
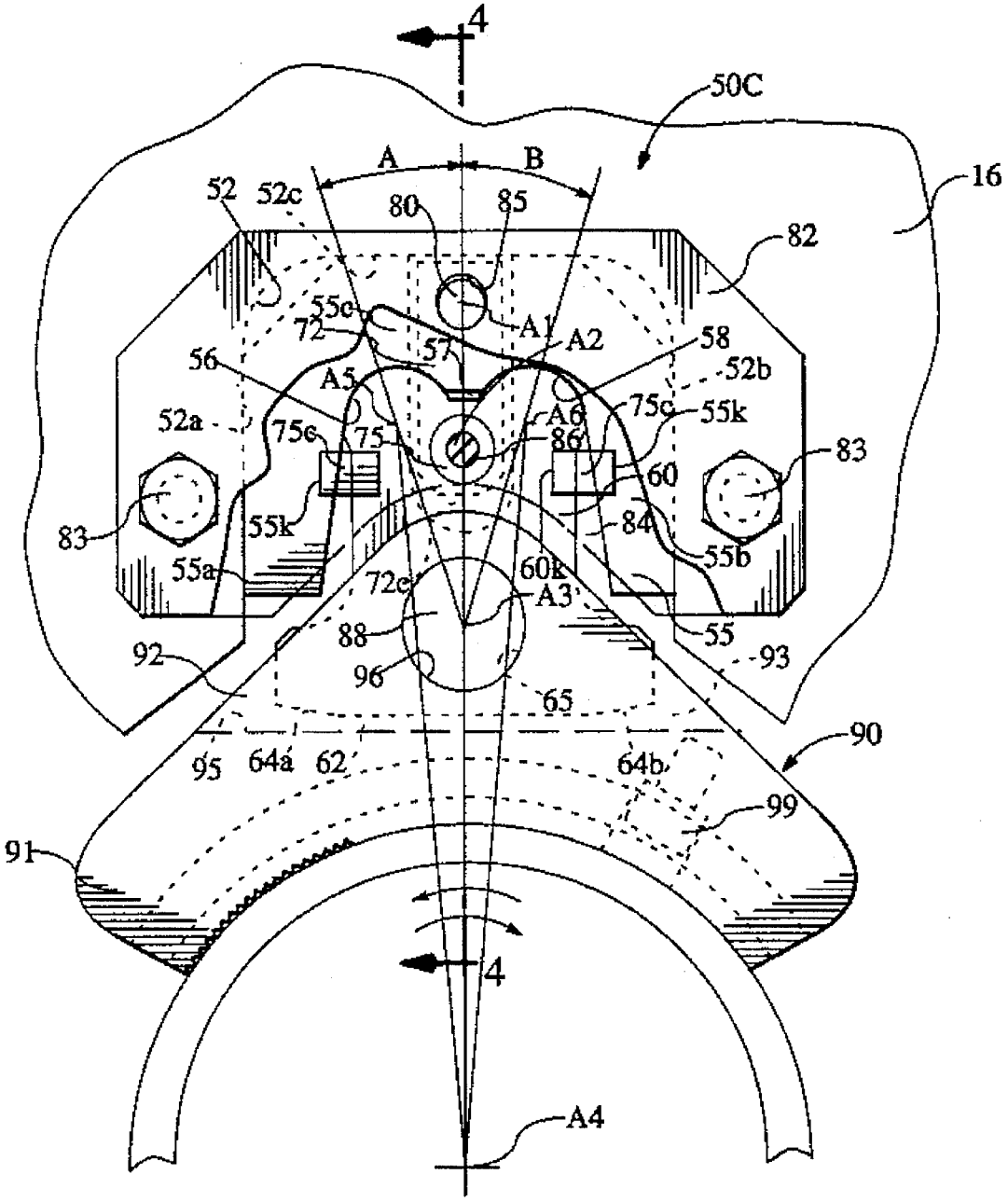
FIG. 3 is an enlarged top plan view of one of the gripping devices.

Referring to FIG. 3, the gripper assembly 50C is illustrated mounted on arm 16. However, it should be appreciated that the gripper assembly 50C may be mounted on any other body suitable for supporting the gripper assembly. Arm 16 has a socket 52 formed therein bounded by side walls 52*a* and 52*b* and a rear wall 52*c*. Rear corners of the socket are rounded to form fillets for reducing stress concentration. Nest member 55 is a generally U-shaped member having spaced flange portions 55*a* and 55*b* connected by a web portion 55*c*. Cylindrical bearing surfaces 56 and 58 are formed in nest member 55 adjacent the intersection of flange portions 55*a* and 55*b* and web portion 55*c*. A narrow flat 57 on the inner surface of web portion 55*c* extends between bearing surfaces 56 and 58. Nest member 55 has a socket 59*a* formed in its upper surface and a socket 59*b* extending through the lower surface.

A force link 60 (best illustrated in FIGS. 4 and 5) extends into the opening between flange portions 55*a* and 55*b* of nest member 55. Link 60 has a front face 62 with shoulders 64*a* and 64*b* formed at opposite ends of front face 62. Link 60 has a central opening 65 extending therethrough for receiving a pin 88 for mounting gripper jaws 90 on link 60, as will be hereinafter more fully explained.

Spaced cylindrical bosses 66 and 68 are formed on the rear end of link 60 and the bosses are positioned adjacent generally cylindrical bearing surfaces 56 and 58, respectively, on nest member 55. Force link 60 thus comprises a double seated linkage (where boss 66 may contact surface 56 and boss 68 may contact surface 58) which is positioned between body 12 of the apparatus and the gripper jaws 90. It should be noted that bosses 66 and 68 and bearing surfaces 56 and 58 have substantially equal radii, such that when boss 66 moves into contact with bearing surface 56, force link 60 begins to rotate about axis A5. When boss 68 moves into contact with bearing surface 58, force link 60 begins to rotate about axis A6. Each axis A5 and axis A6 is located farther from axis A4 of the tubular member than axis A2 about which the force link 60 is initially rotated.

A preferred embodiment of the bi-directional gripping apparatus includes the nest member 55 having spaced bearing surfaces 56 and 58, the force link 60 having a pair of bosses 66 and 68, a pair of straps 72 and 74 having one end pivotally connected to the nest member 55 for rotation about a first axis A1 and a second end pivotally secured to the force link 60 for rotation about a second axis A2. A jaw 90, having a gripping face, or friction surface is pivotally connected to the force link 60 for rotation about a third axis A3. The pivotal mounts permit the force link 60 to move relative to the body 12 and jaw 90 and thus permit transverse displacement of the jaw relative to the body 12. The surface on an elongated tubular member, having a fourth axis, is urged into frictional engagement with the gripping face on the jaw 90. When the jaw 90 and force link 60 are in an initial neutral position, illustrated in FIG. 3, the first, second, third and fourth axes are in alignment such that a force which rotates the elongated tubular member relative to the gripping face on the jaw 90 in either a clockwise or counter clockwise direction about the fourth axis A4 transmits force through the jaw 90 to move the jaw transverse to body 12 to a displaced position. When the jaw is moved to a displaced position, the third axis A3 is moved out of alignment with the first and fourth axes for moving one of the bosses 66 or 68 into engagement with one of the spaced bearing surfaces 56 or 58 on the nest member 55.

After one of the cylindrical bosses 66 or 68 moves into engagement with one of the bearing surfaces 56 or 58, force link 60 will begin to rotate about either axis A5 or A6 until a shoulder on the force link engages an abutment 95 on jaw 90 to prevent overtravel.

Axes A5 and A6 are further away from axis A4 than the second axis (about which link 60 initially rotated) such that further rotation will urge force link 60 into the tubular member. Link 60 thus provides a radial counterforce in response to the rotational force moving the tubular member about axis A4. The radial counterforce (and thus the friction force between the friction surface on jaws 90 and the tubular member) increases proportionally relative to the force moving the tubular member about axis A4.

Figure 5:
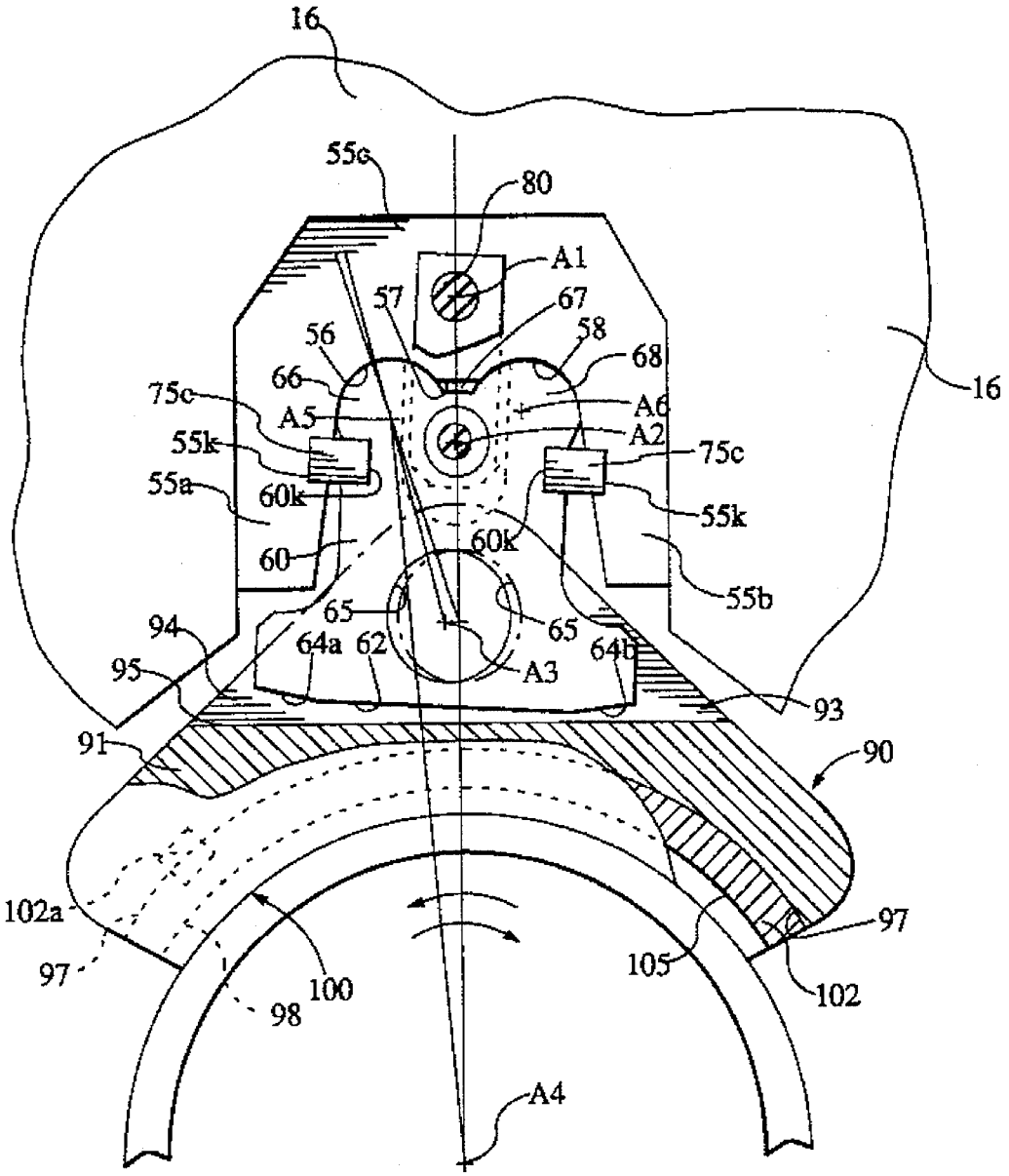
FIG. 5 is a plan view similar to FIG. 3 in which the force link is illustrated in a shifted position resulting from application of force in a counter-clockwise direction, parts being broken away to more clearly illustrate details of construction.

As best illustrated in FIG. 5, a narrow flat portion 67 extends across the rear end of the link 60 between cylindrical bosses 66 and 68.

Figure 4:
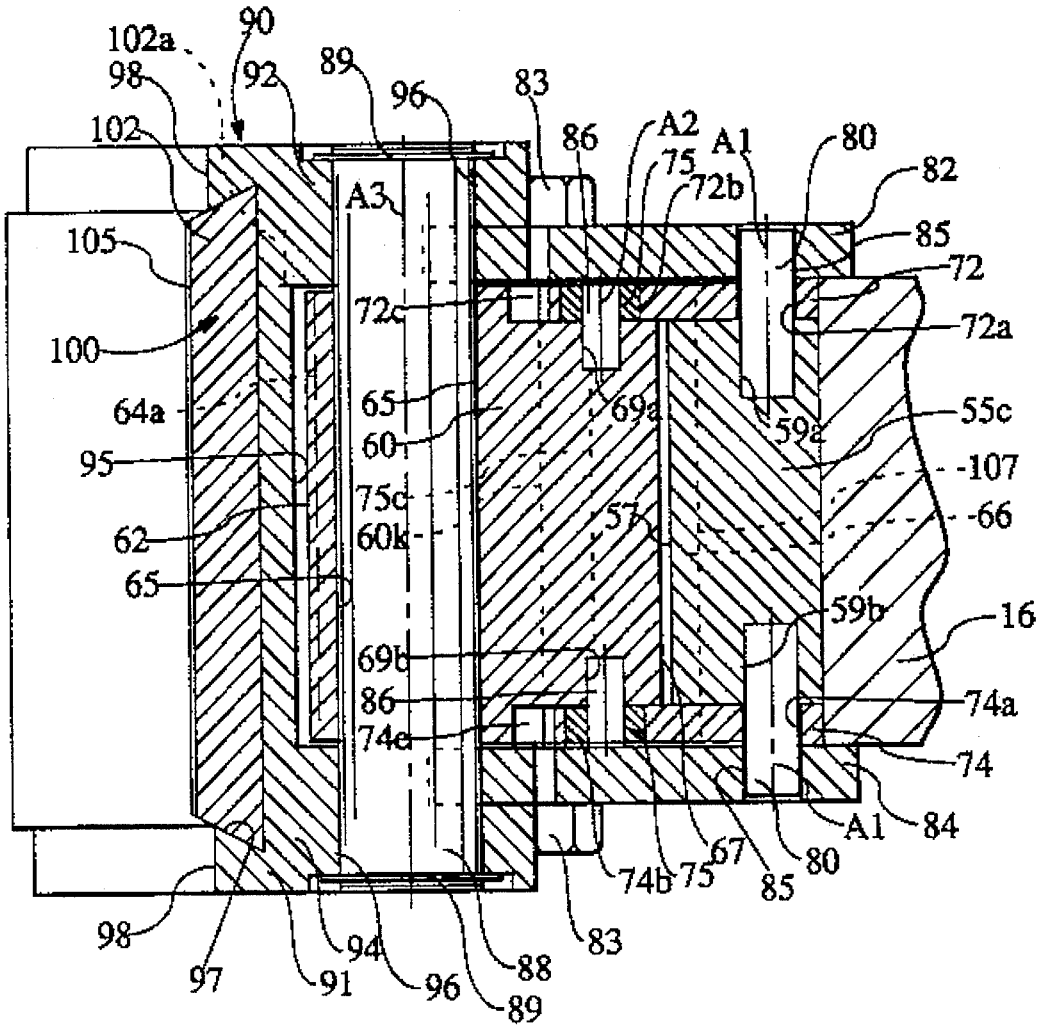
FIG. 4 is a cross-sectional view taken along line 4—4 of FIG. 3.

As illustrated in FIG. 4, socket 69*a* extends through the upper surface of link 60 and a socket 69*b* is formed in the lower side of link 60.

Straps 72 and 74 are mounted in channels 72*c* and 74*c* formed in upper and lower surfaces, respectively, of link 60. Strap 72 has openings 72*a* and 72*b* extending through opposite ends thereof and strap 74 has openings 74*a* and 74*b* extending therethrough. Resilient rings 75 having central openings extending therethrough are mounted in openings 72*b* and 74*b* extending through straps 72 and 74, as will be hereinafter more fully explained.

As best illustrated in FIG. 3, a pair of vertically extending inwardly facing keyways 55*k* are formed in flange portions 55*a* and 55*b* of nest member 55. A pair of vertically extending, outwardly opening keyways 60*k* are formed in opposite sides of force link 60. Elongated elastomeric key members 75*c* extend through keyways 55*k* and 60*k* adjacent opposite sides of force link 60 for resiliently biasing force link 60 toward the position illustrated in FIG. 3 of the drawing. Keyways 55*k* and 60*k* are positioned such that elastomeric key members 75*c* resiliently urge bosses 66 and 68 toward bearing surfaces 56 and 58. Thus, elastomeric key members 75*c* are positioned between nest member 55 and force link 60 for retaining the parts in position and permitting movement of link 60. If it is deemed expedient to do so, straps 72 and 74 may be eliminated or used separately or in combination with elastomeric key members 75*c*.

A top cover plate 82 and a bottom cover plate 84 have openings formed therein. Arm 16 has internally threaded sockets formed therein and bolts 83 extend through the openings in upper and lower cover plates 82 and 84 for securing the cover plates in position, as best illustrated in FIG. 3 of the drawing.

Referring to FIG. 4, cover plates 82 and 84, bolted to upper and lower surfaces of arm 16, capture nest member 55 and the rear end of link 60 therebetween. Plates 82 and 84 have openings 85 formed therein and pins 80, having a common or aligned central axis A1, extend through openings 85 in upper and lower cover plates 82 and 84, through openings 72*a* and 74*a* in straps 72 and 74 and into sockets 59*a* and 59*b* in the web portion 55*c* of nest member 55. A pair of pins 86 extend through the central openings in resilient rings 75 and into sockets 69*a* and 69*b* formed in the rear end of power link 60. Pins 86 have aligned axes A2. A pin 88 having a central axis A3 extends through opening 65 in the front end of power link 60 for mounting a gripper jaw assembly, generally designated by the numeral 90, to force link 60.

As best illustrated in FIGS. 3, 4 and 5, the body portion 91 of gripper assembly 90 has a groove 93 formed therein to provide an upper mounting lobe 92, a lower mounting lobe 94 and an abutment surface 95. Upper and lower mounting lobes 92 and 94 have openings 96 extending therethrough into which opposite ends of pin 88, having an axis A3 extend. Snap rings 89 secure pin 88 against longitudinal movement.

As illustrated in FIG. 4, an arcuately extending dove-tail groove 97 is formed in the curved front face 98 of the body 91 of the gripper assembly. A gripper insert 100, having a dove-tailed projection 102 formed on the rear end thereof, is mounted in groove 97 and retained in position by one or more set or cap 99.

The gripper insert 100 has a surface 105 having a high coefficient of friction and may be provided with teeth. A hard aggregate suspended in a hard elastomer material may be used to provide a sandpaper-like surface 105 to assure a high coefficient of friction between the surface 105 and pipe T. The friction surface 105 is contained on insert 100 which slides into the jaw and retained by cap screw 99 and a key 102*a*. The head of the cap screw 99 or the key 102*a* are put in shear to take the shear loads from applied torque.

The features of the embodiments described hereinabove may be incorporated into various structural designs. It will be understood, therefore, that although the invention has been described with particular reference to specific embodiments, the forms thereof shown and described in detail are to be taken as preferred embodiments. Various changes, modifications, substitutions and rearrangements of parts may be resorted to without departing from the spirit and scope of the appended claims.

What is claimed:

1. A method of applying or holding a torsional force in either a clockwise or a counter-clockwise direction about an axis of an elongated member comprising the steps of:

positioning a force link having first and second cylindrical bosses adjacent a nest member having first and second spaced cylindrical bearing surfaces;

pivotally securing opposite ends of a tension carrying strap such that one end of said strap is pivotally secured to said nest member and such that a second end of said strap is pivotally secured to said force link between said cylindrical bosses;

pivotally securing a jaw having a gripping surface to said force link;

urging said gripping face on said jaw into frictional engagement with the surface of the elongated member; and applying force for moving said elongated member relative to said jaw such that frictional force is transferred through said jaw for rotating said force link whereby said first cylindrical boss is moved into engagement with said first bearing surface if the force is in a clockwise direction and said second cylindrical boss is moved into engagement with said second bearing surface if the force is in a counter-clockwise direction.

2. Bi-directional gripping apparatus for limiting movement of an elongated member having an outer surface and a longitudinal axis comprising:

a nest member having spaced bearing surfaces;

a force link having a pair of bosses;

a strap having one end pivotally connected to said nest member for rotation about a first axis and a second end pivotally secured to said force link for rotation about a second axis for moveably securing said force link to said nest member;

a jaw having a gripping face, said jaw being pivotally connected to said force link for rotation about a third axis; and means for urging a surface on an elongated member having a fourth axis into frictional engagement with said gripping face such that said first, second, third and fourth axes are in alignment and such that rotation of said elongated member relative to said gripping face in either direction about said fourth axis transmits force through said jaw for moving said third axis out of alignment with said first and fourth axes for moving one of said bosses into engagement with one of said spaced bearing surfaces on said nest member.

3. Apparatus as defined in claim 2 wherein said nest member has inwardly opening keyways and said force link having outwardly opening keyways and includes elongated elastomeric keys in said keyways positioned for urging each of said bosses on said force link toward said bearing surfaces on said nest member.

4. Apparatus as defined in claim 2 wherein said strap has an opening in one end thereof and an elastomeric member in said opening, said elastomeric member having a passage formed therein; and wherein said force link has a bore and said strap is pivotally secured to said force link by a pin extending into said bore in said force link and into said passage in said elastomeric member.

5. Apparatus as defined in claim 2 wherein said force link has spaced shoulders formed thereon and said jaw has spaced abutments formed thereon, said shoulders and said abutments being spaced apart from one another when said first, second, third and fourth axes are in aligment, said shoulder and said abutment moves into engagement to limit movement of said jaw relative to said force link when said third axis moves out of aligment with said first and fourth axes.

6. Apparatus as defined in claim 2 wherein said gripping face on said jaw has hardened teeth for grippingly engaging the elongated member.

7. Apparatus as defined in claim 2 wherein said gripping face has a sandpaper-like surface for grippingly engaging the elongated member.

8. Bi-directional gripping apparatus for gripping an elongated cylindrical member having an outer surface and a longitudinal axis comprising:

a nest member having spaced flanges and a web extending between said flanges for forming spaced bearing surfaces, said spaced flanges having inwardly facing keyways;

a force link having a pair of bosses adjacent opposite sides thereof, said force link having outwardly opening keyways formed therein;

a pair of elongated elastomeric key members extending through said keyways in said nest member and said force link, said elastomeric keys urging said bosses on said force link toward said bearing surfaces on said nest member;

a jaw having a gripping face, said jaw being pivotally connected to said force link; and means for urging the outer surface on said elongated cylindrical member into engagement with said gripping face on said jaw such that rotation of said elongated cylindrical member about said longitudinal axis in either direction moves one of said bosses on said force link into engagement with one of said bearing surfaces on said nest member for exerting torque resisting movement of said elongated cylindricalmember which is proportional to torque applied to the elongated cylindrical member tending to rotate the member relative to said jaw.

9. Bi-directional gripping apparatus as defined in claim 8 wherein said force link has spaced shoulders formed thereon and said jaw has spaced abutments formed thereon with said shoulders and said abutments positioned to limit movement of said jaw relative to said force link for limiting force between said jaw and said elongated cylindrical member to prevent crushing said elongated cylindrical member.

* * * * *